US009573143B2

(12) United States Patent
Lin et al.

(10) Patent No.: US 9,573,143 B2
(45) Date of Patent: Feb. 21, 2017

(54) SIDE SPRAYING SHOWER HEAD

(71) Applicants: XIAMEN SOLEX HIGH-TECH INDUSTRIES CO., LTD., Xiamen, Fujian (CN); Huasong Zhou, Xiamen, Fujian (CN)

(72) Inventors: Fengde Lin, Xiamen (CN); Wenxing Chen, Xiamen (CN); Jincan Zhang, Xiamen (CN); Huasong Zhou, Xiamen (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 160 days.

(21) Appl. No.: 14/523,181

(22) Filed: Oct. 24, 2014

(65) Prior Publication Data

US 2015/0115065 A1 Apr. 30, 2015

(30) Foreign Application Priority Data

Oct. 25, 2013 (CN) ..... 2013 1 0514215

(51) Int. Cl.
*B05B 1/18* (2006.01)
*B05B 1/16* (2006.01)

(52) U.S. Cl.
CPC ..... *B05B 1/18* (2013.01); *B05B 1/1618* (2013.01); *B05B 1/185* (2013.01); *B05B 1/1609* (2013.01)

(58) Field of Classification Search
CPC ..... B05B 1/18; B05B 1/1618; B05B 1/1609; B05B 1/185
USPC ..... 239/446, 447, 449
See application file for complete search history.

(56) References Cited

U.S. PATENT DOCUMENTS 5,467,927 A * 11/1995 Lee ..... A61H 23/04 239/383
7,628,341 B2 * 12/2009 Kajuch ..... B05B 1/18 239/227
7,766,260 B2 * 8/2010 Lin ..... B05B 1/1618 239/389
2011/0192915 A1 * 8/2011 Li ..... B05B 1/18 239/394
2012/0012676 A1 * 1/2012 Hu ..... B05B 1/1663 239/525

(Continued)

FOREIGN PATENT DOCUMENTS

CN 102139250 A 8/2011

*Primary Examiner* — Arthur O Hall
*Assistant Examiner* — Alexander Valvis
(74) *Attorney, Agent, or Firm* — Rabin & Berdo, P.C.

(57) ABSTRACT

A side spraying shower head includes an inlet waterway; a cover unit with a first and second water cavity; a water diversion body covering the cover unit, the water diversion body having a first inlet hole connected to the first water cavity and a second inlet hole connected to the second water cavity; a fixation base attached to the water diversion body, the fixation base including a first connection waterway and a second connection; a switch shaft, laterally movable inside the fixation base, the central portion of the switch shaft including a seal portion disposed between the first and second connection waterway; a press mechanism attached to the cover unit to push the switch shaft to close the second connection waterway; an elastic element abuts against the switch shaft and the fixation base to push the switch shaft to close the first connection waterway.

4 Claims, 3 Drawing Sheets

(56) References Cited

U.S. PATENT DOCUMENTS

2013/0239320 A1* 9/2013 Aihara ..... B05B 1/12
4/615

* cited by examiner

SIDE SPRAYING SHOWER HEAD

FIELD OF THE INVENTION

The present invention relates to a side spraying shower head.

BACKGROUND OF THE INVENTION

A shower head with adjustable spraying direction of invention for patent is disclosed in Aug. 3, 2011 with publication number CN102139250A in Chinese patent database. The shower comprises a spraying side and shower head components, the shower head components comprise an inlet component and a two-way connector. The two-way connector is connected between the spraying side and the inlet component, the two-way connector is used to make the spraying side rotate, so that the shower head can spray water in different directions to a human body.

However, this kind of shower head has only one spraying water type, it is single in function and is available in a small area.

SUMMARY OF THE INVENTION

The present invention is provided with a side spraying shower head, which overcomes the disadvantages of the existing technology. The technical proposal of the present invention to solve the technical problem is that:

A side spraying shower head, comprising: an inlet waterway;

a cover unit with a first water cavity and a second water cavity;

a water diversion body covering the cover unit, the water diversion body comprising a first inlet hole which is connected to the first water cavity and a second inlet hole which is connected to the second water cavity;

a fixation base attached to the water diversion body, the fixation base including a first connection waterway which connects the inlet waterway and the first inlet hole and a second connection waterway which connects the inlet waterway and the second inlet hole;

a switch shaft, movable back and forth laterally inside the fixation base, the central portion of the switch shaft including a seal portion disposed between the first connection waterway and the second connection waterway to alternately close the first connection waterway and the second connection waterway;

a press mechanism attached to the cover unit to push the switch shaft to move at a first direction to close the second connection waterway;

an elastic element abuts against the switch shaft and the fixation base to push the switch shaft to move at a second direction to close the first connection waterway.

The first connection waterway connects the inlet waterway and the first inlet hole, the second connection waterway connects the inlet waterway and the second inlet hole, controlling the press mechanism to make the switch shaft move forth and back laterally inside the fixation base, so that the seal portion of the switch shaft alternately closes the first connection waterway and the second connection waterway to make the inlet waterway connected to the first water cavity or the second water cavity, thus making the shower head spray different water types.

In another preferred embodiment, the fixation base comprises a main body and a valve body, the valve body is embedded into the main body, the switch shaft runs through the valve body, the valve body is disposed with a breach, the top portion of the main body is disposed with a punch, the bottom portion of the main body is disposed with a first through hole and a second through hole, the punch, the interior of the valve body, the breach and the first through hole are connected to form the first connection waterway, the punch, the interior of the main body and the second through hole are connected to form the second connection waterway.

The fixation base is disposed with a punch, a first through hole, a second through hole and a breach in different positions so as to form the first connection waterway and the second connection waterway, which is simple in structure.

In another preferred embodiment, the switch shaft further comprises a first waterseal portion and a second waterseal portion, the seal portion is disposed between the first waterseal portion and the second waterseal portion, the breach is disposed between the first waterseal portion and the seal portion, the second through hole is disposed between the seal portion and the second waterseal portion, the seal portion, the first waterseal portion and the second waterseal portion have same section areas, the first waterseal portion, the second waterseal portion are respectively sleeved with sealing rings.

The seal portion, the first waterseal portion and the second waterseal portion have same sectional area, when water flows into the first connection waterway, the water pressures of the first waterseal portion and the seal portion are equal to cancel out, the switch shaft is easier to move, so that the operation handle feels light. Also, when water flows into the second connection waterway, the water pressures of the second waterseal portion and the seal portion are equal to cancel out, the switch shaft is easier to move, the operation handle feels light.

In another preferred embodiment, the press mechanism comprises a push block, the push block is movable back and forth vertically inside the fixation base, one side of the push block is disposed with an inclined push face, the end portion of the switch shaft is disposed to an press-fit face, the press-fit face abuts against the inclined push face.

The push block moves vertically to push the switch shaft to move laterally, the side spraying shower head has reasonable and simple structure and small size.

In another preferred embodiment, the press mechanism further comprises a valve spool, a valve shaft and a reset element, the reset element abuts against the fixation base and the push block, the valve spool abuts against the bottom surface of the push block, the valve spool is disposed with inclined teeth, the valve shaft is disposed with push teeth coupled to the inclined teeth, the valve shaft is movable back and forth vertically inside the cover unit, the valve shaft pushes the valve spool to move vertically, so that the valve cover rotates.

BRIEF DESCRIPTION OF THE DRAWINGS

The present invention will be further described with the drawings and the embodiments.

DETAILED DESCRIPTION OF THE EMBODIMENTS

Figure 1:
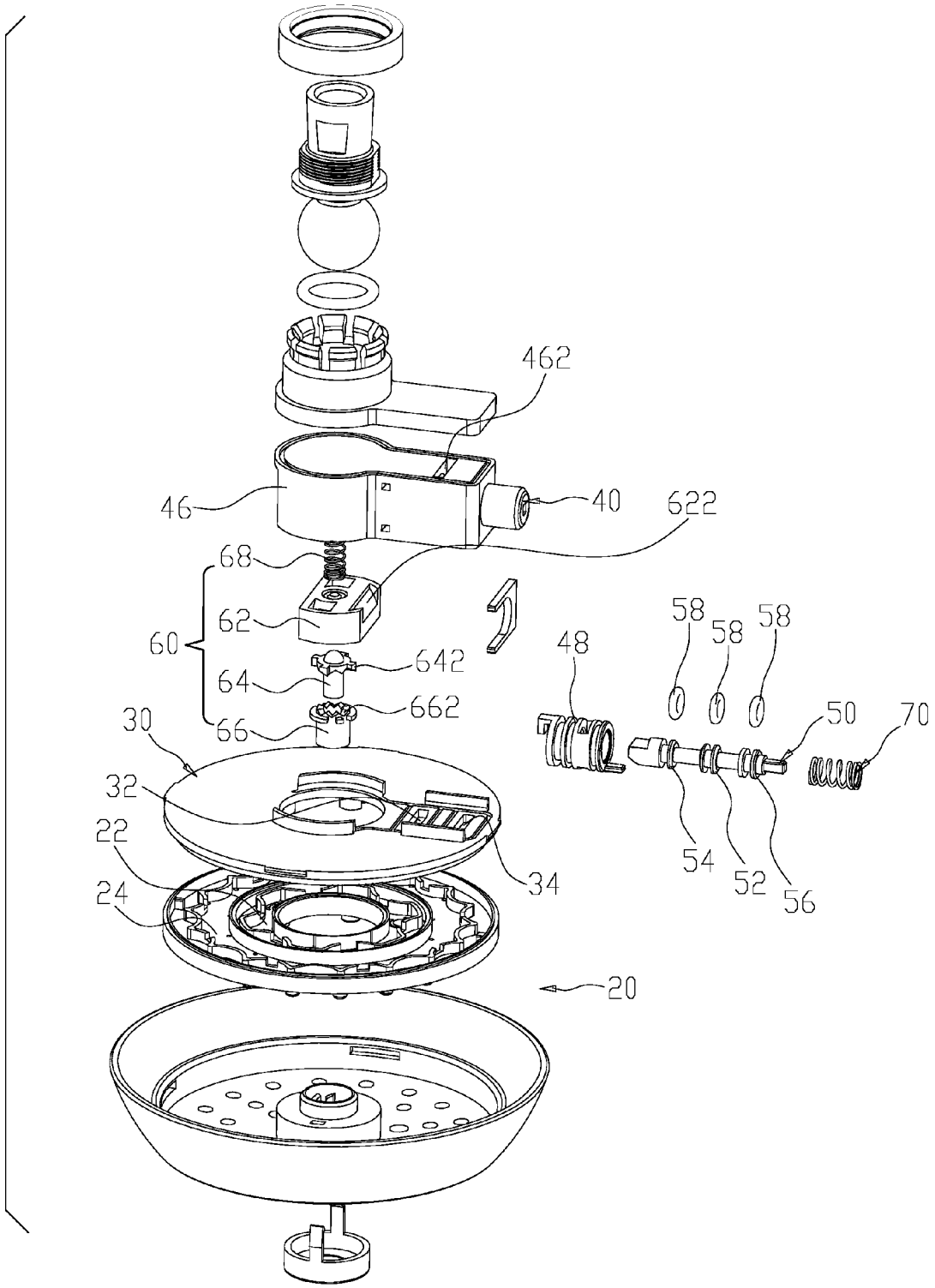
FIG. 1 illustrates an exploded and schematic diagram of a side spraying shower head of the present invention.
Figure 2:
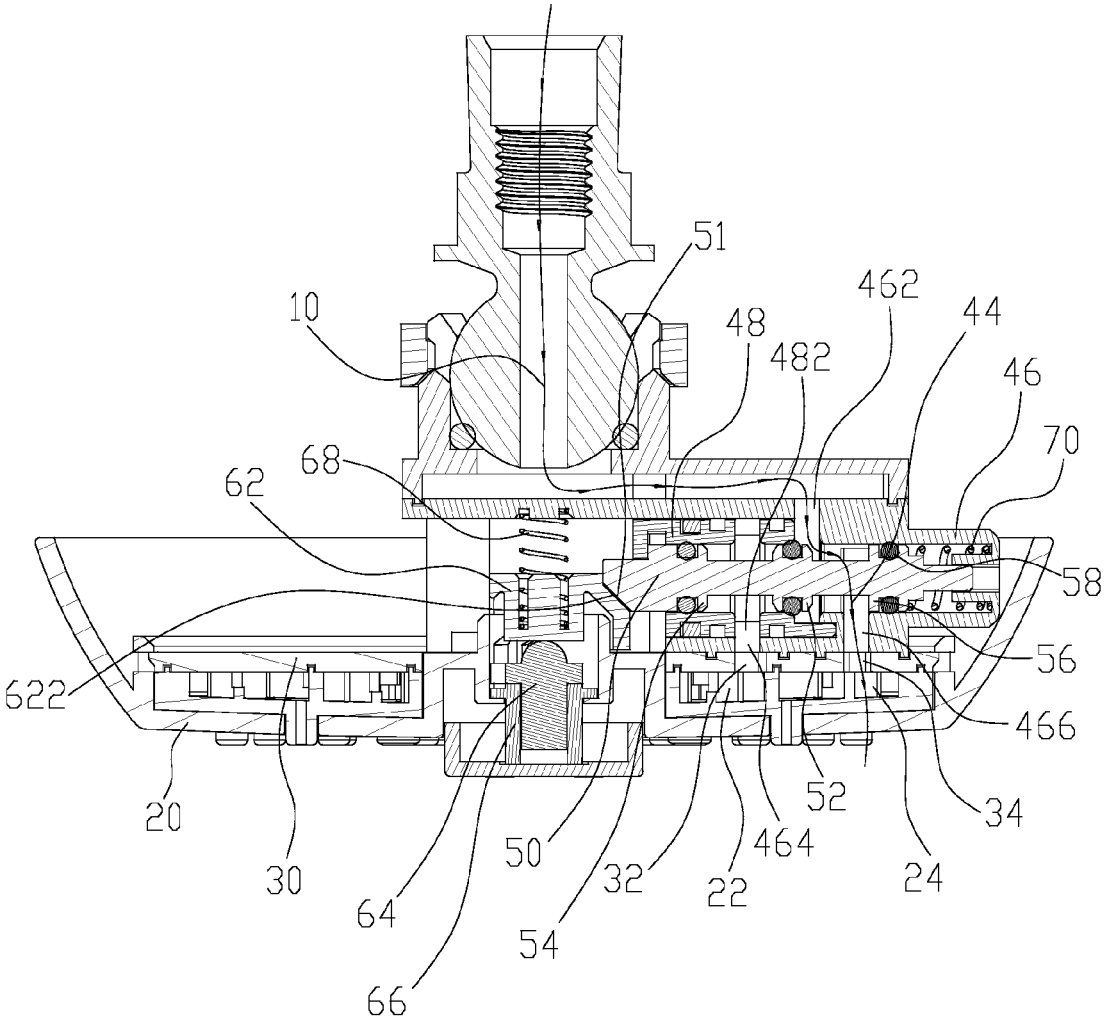
FIG. 2 illustrates a first sectional diagram of the side spraying shower head of FIG. 1.
Figure 3:
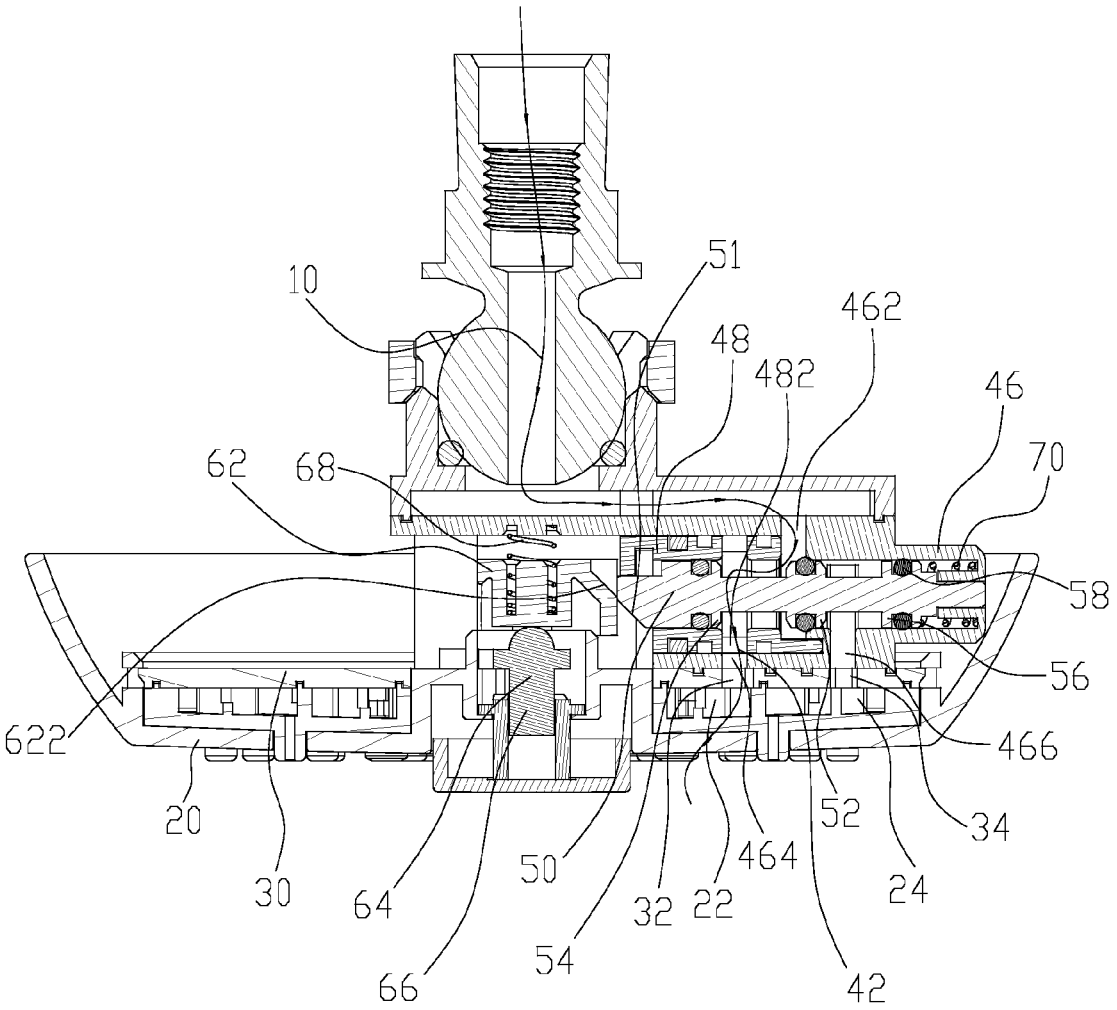
FIG. 3 illustrates a second sectional diagram of the side spraying shower head of FIG. 1.

Please refer to FIG. 1 to FIG. 3, a side spraying shower head of the present invention comprises an inlet waterway 10. The side spraying shower head comprises a cover unit 20, a water diversion body 30, a fixation base 40, a switch shaft 50, a press mechanism 60 and an elastic element 70.

The cover unit 20 is disposed with a first water cavity 22 and a second water cavity 24. When the first water cavity 22 is connected to the inlet waterway 10, the cover unit 20 discharges spraying water out. When the second water cavity 24 is connected to the inlet waterway 10, the cover unit 20 discharges shower water out.

The water diversion body 30 covers on the cover unit 20. The water diversion body 30 comprises a first inlet hole 32 and a second inlet hole 34. The first inlet hole 32 is disposed right above the first water cavity 22 and is connected to the first water cavity 22. The second inlet hole 34 is disposed right above the second water cavity 24 and is connected to the second water cavity 24.

The fixation base 40 is attached to the water diversion body 30. The fixation base 40 is disposed with a first connection waterway 42 and a second connection waterway 44. The first connection waterway 42 is used to connect the inlet waterway 10 and the first inlet hole 32, so that water flows to the first water cavity 22. The second connection waterway 44 is used to connect the inlet waterway 10 and the second inlet hole 34, so that water flows to the second water cavity 24.

The fixation base 40 comprises a main body 46 and a valve body 48. The main body 46 is a hollow housing. The top portion of the main body 46 is disposed with a punch 462, the bottom portion of the main body 46 is disposed with a first through hole 464 and a second through hole 466, the first through hole 464 and the second through hole 466 are respectively disposed at the left and right sides of the punch 462. The first through hole 464 is disposed right above the first inlet hole 32. The second through hole 466 is disposed right above the second inlet hole 34. The valve body 48 is sleeve pipe structural. The side wall of the valve body 48 is disposed with a breach 482. The valve body 48 inserts to the main body 46 from one side of the first through hole 464, and the valve body 48 does not pass the punch 462. One side of the first through hole 464 aligns the breach 482 vertically. The punch 462, the inner side of the valve body 48, the breach 482 and the first through hole 464 are connected to form the first connection waterway 42. The punch 462, the inner side of the main body 46 and the second through hole 466 are connected to form the second connection waterway 44.

The switch shaft 50 can move forth and back laterally inside the fixation base 40. The switch shaft 50 runs through the valve body 48. The switch shaft 50 comprises a seal portion 52, a first waterseal portion 54 and a second waterseal portion 56. The seal portion 52 is arranged in the center of the first waterseal portion 54 and the second waterseal portion 56. The breach 482 is arranged between the first waterseal portion 54 and the seal portion 52, the second through hole 466 is arranged between the seal portion 52 and the second waterseal portion 56, that is to say, the seal portion 52 is arranged between the first connection waterway 42 and the second connection waterway 44. The seal portion 52, the first waterseal portion 54 and the second waterseal portion 56 have same sectional areas. The sea portion 52, the first waterseal portion 54 and the second waterseal portion 56 are respectively sleeved with sealing ring 58. The seal portion 52 is used to close the first connection waterway 42 or the second connection waterway 44. when the switch shaft 50 moves left to make the sealing ring 58 of the seal portion 52 close the inner passage of the valve body 48 (as figured in FIG. 2), the first connection waterway 42 is blocked. When the switch shaft 50 moves right to make the sealing ring of the seal portion 52 close the inner passage of the main body 46 (as figured in FIG. 3), the second connection waterway 44 is blocked. The end of the switch shaft 50 is disposed with an inclined press-fit face 51.

The press mechanism 60 is used to push the switch shaft 50 to make the switch shaft 50 move right. The press mechanism 60 is attached on the cover unit 20. The press mechanism 60 comprises a push block 62, a valve spool 64, a valve shaft 66 and a reset element 68. one side of the push block 62 is disposed with an inclined push face 622. the valve spool 64 is disposed with inclined teeth 642. The valve shaft 66 is disposed with push teeth 662 coupled to the inclined teeth 642.

The push block 62 is movable forth and back vertically inside the fixation base 40, the press-fit face 51 abuts against the inclined push face 622, the reset element 68 abuts against the fixation base 40 and the push block 62 therebetween. The valve spool 64 abuts against the bottom surface of the push block 62. The valve shaft 66 is movable forth and back vertically inside the cover unit 20. The inclined teeth 642 are coupled to the push teeth 662.

The elastic element 70 abuts against the switch shaft 50 and the fixation base 40 therebetween.

When pressing the valve shaft 66 at the first time to push the valve spool 64 to overcome the elastic force of the reset element 68 to move upwardly, the inclined push face 622 pushes the switch shaft 50, so that the switch shaft 50 overcomes the elastic force of the elastic element 70 to move right to make the seal portion 52 close the second connection waterway 44. The push teeth 662 and the inclined teeth 642 cooperate to make the valve spool 64 rotate, so that the valve spool 64 abuts against the cover unit 20 and thus keep in the higher position.

When pressing the valve shaft 66 at the second time to push the valve spool 64 move upwardly vertically, the push teeth 662 and the inclined teeth 642 cooperate to make the valve spool 64 rotate, the valve spool 64 moves away from the cover unit 20, the reset element 68 abuts against the valve spool 64 to make the valve spool 64 move downwardly to the lower position, the elastic element 70 abuts against the switch shaft 50 to make the switch shaft 50 move left to close the first connection waterway 42.

The press mechanism has same structure and work principle as the mechanical pencil, so that it will not be described here.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A side spraying shower head, comprising:

an inlet waterway;

a cover unit with a first water cavity and a second water cavity;

a water diversion body covering the cover unit, the water diversion body comprising a first inlet hole which is connected to the first water cavity and a second inlet hole which is connected to the second water cavity;

a fixation base attached to the water diversion body, the fixation base including a first connection waterway which connects the inlet waterway and the first inlet hole and a second connection waterway which connects the inlet waterway and the second inlet hole;

a switch shaft, movable back and forth laterally inside the fixation base, a central portion of the switch shaft including a seal portion disposed between the first connection waterway and the second connection waterway to alternately close the first connection waterway and the second connection waterway;

a press mechanism attached to the cover unit to push the switch shaft to move at a first direction to close the second connection waterway;

an elastic element abuts against the switch shaft and the fixation base to push the switch shaft to move at a second direction to close the first connection waterway, wherein the press mechanism comprises a push block, where the push block is movable back and forth vertically inside the fixation base, one side of the push block is provided with an inclined push face, an end portion of the switch shaft is provided with a press-fit face, and the press-fit face abuts against the inclined push face.

2. The side spraying shower head according to claim 1, wherein the fixation base comprises a main body and a valve body, the valve body is embedded into the main body, the switch shaft runs through the valve body, the valve body is disposed with a breach, a top portion of the main body is disposed with a punch, a bottom portion of the main body is disposed with a first through hole and a second through hole, the punch, an interior of the valve body, the breach and the first through hole are connected to form the first connection waterway, the punch, an interior of the main body and the second through hole are connected to form the second connection waterway.

3. The side spraying shower head according to claim 1, wherein the switch shaft further comprises a first waterseal portion and a second waterseal portion, the seal portion is disposed between the first waterseal portion and the second waterseal portion, a breach is disposed between the first waterseal portion and the seal portion, a through hole is disposed between the seal portion and the second waterseal portion, the seal portion, the first waterseal portion and the second waterseal portion have same section areas, the first waterseal portion, the second waterseal portion are respectively sleeved with sealing rings.

4. The side spraying shower head according to claim 2, wherein the press mechanism further comprises a valve spool, a valve shaft and a reset element, the reset element abuts against the fixation base and the push block, the valve spool abuts against the bottom surface of the push block, the valve spool is disposed with inclined teeth, the valve shaft is disposed with push teeth coupled to the inclined teeth, the valve shaft is movable back and forth vertically inside the cover unit, the valve shaft pushes the valve spool to move vertically, so that the valve spool rotates.

* * * * *